US005240394A

United States Patent [19]

James

[11] Patent Number: 5,240,394

[45] Date of Patent: Aug. 31, 1993

[54] CORNER RADIUS TOOL

[75] Inventor: Kenneth O. James, Columbia Falls, Mont.

[73] Assignee: Frank R. Strickland, Lakeside, Mont.

[21] Appl. No.: 11,225

[22] Filed: Jan. 29, 1993

[51] Int. Cl.[5] ..... B05C 17/10

[52] U.S. Cl. ..... 425/458; D8/45; 15/235.7

[58] Field of Search ..... 425/87, 458, 276, 278; 401/11; 15/235.7, 236.07, 245.1, 235.4; D8/45

[56] References Cited

U.S. PATENT DOCUMENTS 2,114,703 4/1938 Conner ..... 425/458

3,358,619 12/1967 Pareira ..... 425/276

*Primary Examiner*—Jay H. Woo

*Assistant Examiner*—Joseph Leyson

*Attorney, Agent, or Firm*—Kelly Bauersfeld & Lowry

[57] ABSTRACT

A corner radius tool is provided for use in applying plaster material or the like to an inside corner joint between drywall panels to form a controlled and smoothly radiused surface. The tool includes a tool head in the form of a forwardly open resilient cup carried at a forward end of a tool handle, wherein the cup is adapted to support a quantity of the plaster material as the handle is manipulated to press and spread the plaster material along the inside corner joint. The resilient cup deforms upon engagement with the drywall panels at the corner joint to spread the plaster material with a desired and smoothly radiused surface. The specific radiused geometry of the plaster material surface is variably controlled by varying the orientation of and manual pressure applied to the resilient cup.

7 Claims, 2 Drawing Sheets

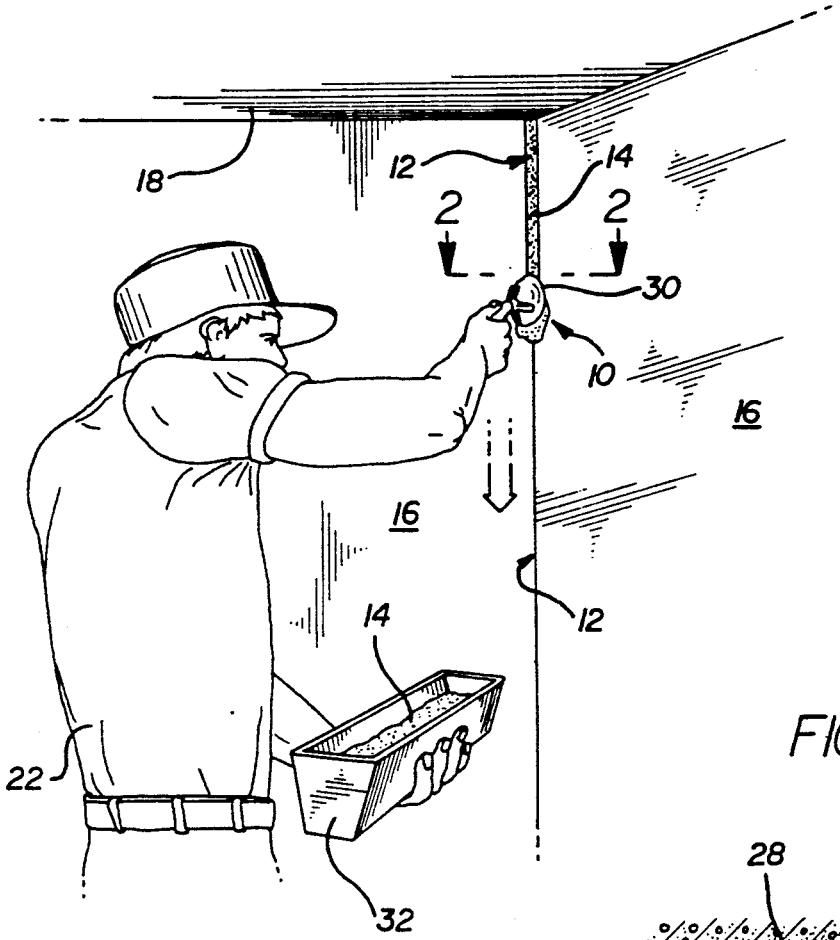
FIG. 1
FIG. 2
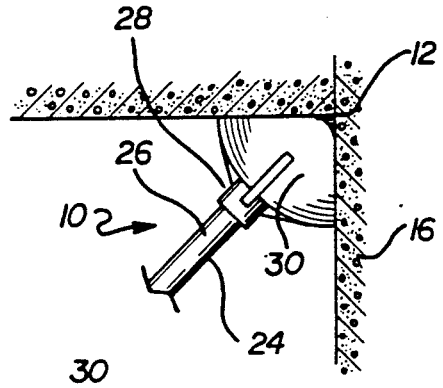
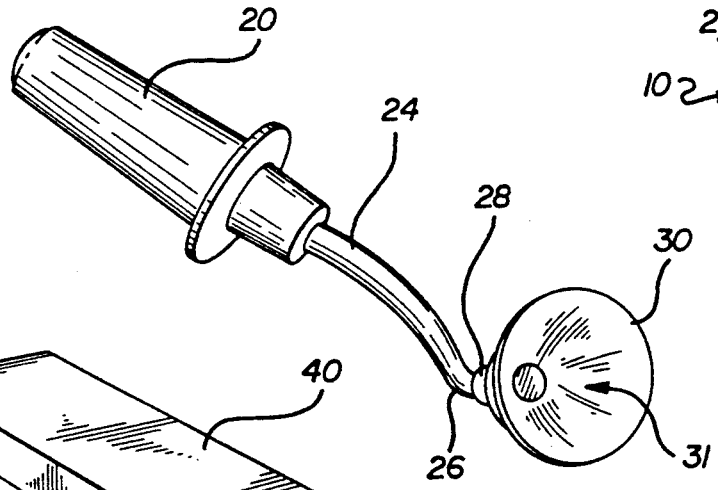
FIG. 3
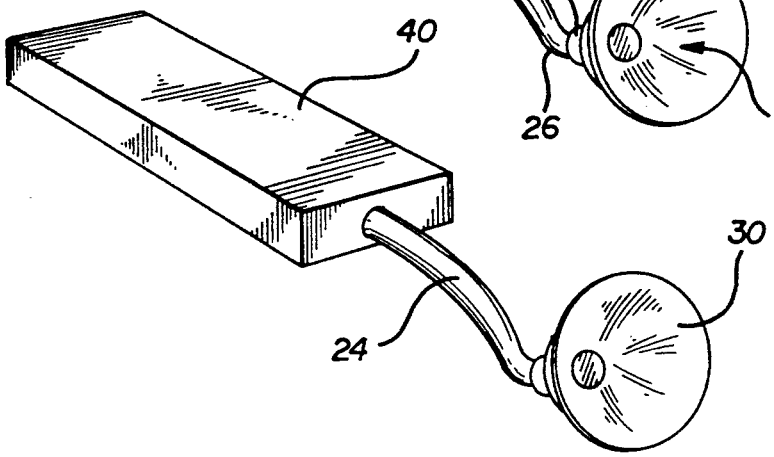
FIG. 8

CORNER RADIUS TOOL

BACKGROUND OF THE INVENTION

This invention relates generally to tools and related methods of use for applying plaster material or the like to an inside corner joint between adjacent drywall panels in a building. More specifically, this invention relates to an improved and easy-to-use corner radius tool for spreading plaster material along an inside corner joint with a smoothly radiused and variably selected surface geometry.

Drywall panels of plaster-board material or the like are used extensively in residential and commercial construction projects to form interior walls within a building structure. In accordance with common construction techniques, the drywall panels are securely mounted onto frame components such as wall studs. Thereafter, joints formed between adjacent drywall panels are taped and filled with plaster material or the like to form a desired smooth and substantially uninterrupted wall surface.

The process of taping and filling exposed joints between adjacent drywall panels involves substantial manual labor and considerable skill to provide the desired smooth and attractive wall surface. In this regard, particular difficulties are encountered in filling an inside angle corner joint. More specifically, plaster material is pressed into and spread along the inside corner joint in an effort to form a smoothly radiused corner surface of substantially continuous cross-sectional geometry for the entire length of the corner joint. Variations in a radiused inside corner, involving fluctuations in sharpness of the corner contour, can be particularly unsightly.

In the past, various manual tools have been provided for use by construction workers in the taping and filling of joints between drywall panels. Some of these tools have been specially adapted for applying plaster material to an inside corner joint, and in a manner providing a substantially uniform radiused surface at the corner joint. Such tools, however, have included rigid tool heads for spreading the plaster material with a fixed surface geometry, within an inside corner of fixed angular shape, for example, a ninety degree corner. Prior corner radius tools have not provided the ability to selectively vary the geometry of a smoothly radiused plaster material surface at an inside corner joint, nor have such prior tools been capable of forming a smoothly radiused surface on an inside corner joint formed at an angle other than ninety degrees.

The present invention overcomes the problems and disadvantages encountered in the prior art, by providing an improved corner radius tool for applying plaster material to an inside corner joint between adjacent drywall panels, wherein a smoothly radiused corner surface of variably selected geometry can be formed quickly and easily at an inside corner of virtually any angle.

SUMMARY OF THE INVENTION

In accordance with the invention, a corner radius tool is provided for applying plaster material or the like to an inside corner joint between adjacent drywall panels in a building structure. The improved corner radius tool includes a resilient tool head for supporting a quantity of the plaster material as the tool head is pressed into and moved along an inside corner joint. The tool head deforms against the drywall panels at the corner joint and is shaped when deformed to define a trailing edge of selected geometry for spreading the plaster material with a smoothly radiused surface as the tool head is drawn along the corner joint. The specific geometry of the radiused surface is variably selected by the orientation of the tool head relative to the corner joint and manual pressure applied to the tool head. By drawing the tool head along the corner joint at substantially constant orientation and pressure, a smoothly radiused corner surface of uniform cross-sectional shape is formed.

In accordance with the preferred form of the invention, the improved corner radius tool comprises a manually grasped handle having a tool shank projecting forwardly therefrom. The tool head comprises a resilient cup mounted at a forward end of the tool shank, wherein the resilient cup defines a forwardly presented concave cup interior for receiving a quantity of the plaster material or the like. In the preferred form, the forward end of the tool shank includes a bend for supporting the resilient cup at an angle of about 30° to a longitudinal axis of the tool handle. In addition, diametric cup sizes on the order of about two to four inches are preferred.

In use, the corner radius tool can be used to scoop a quantity of the plaster material into the concave resilient cup. The plaster material is then pressed into an inside corner joint, and drawn along the joint in either direction while maintaining the resilient cup at a substantially constant orientation and under substantially constant manual pressure.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view illustrating use of a corner radius tool embodying the novel features of the invention for applying plaster material or the like to an inside corner joint between adjacent drywall panels;

FIG. 2 is an enlarged fragmented horizontal sectional view taken generally on the line 2—2 of FIG. 1;

FIG. 3 is an enlarged perspective view illustrating the corner radius tool of FIG. 1;

FIG. 8 is a perspective view illustrating an alternative preferred form of the invention.

DETAILED DESCRIPTION OF THE PREFERRED EMBODIMENTS

Figure 4:
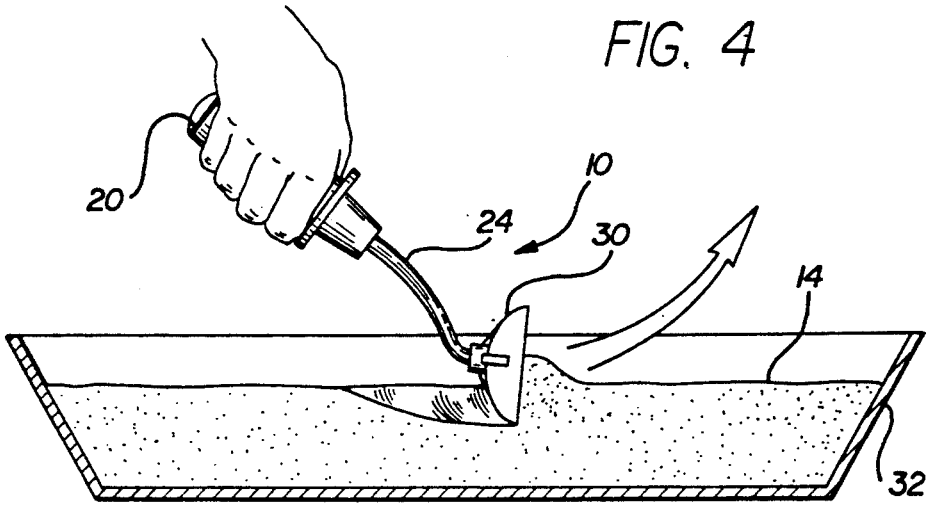
FIG. 4 is a fragmented side elevational view, shown partially in vertical section, illustrating use of the tool for scooping a quantity of plaster material or the like from a hand-held tray.

As shown on the exemplary drawings, a corner radius tool referred to generally by the reference numeral 10 is provided for filling an inside corner joint 12 with a plaster material 14 or the like to define a smoothly radiused corner surface, as viewed in FIG. 1. The inside corner joint 12 is formed at the intersection of adjacent drywall panels 16. Appropriate orientation and manipulation of the corner radius tool 10 provides easily varied selection of the geometry of the radius corner surface. Moreover, the tool 10 may be used for filling inside corner joints of virtually any angle.

FIG. 1 illustrates use of the corner radius tool 10 of the present invention for filling a vertical inside corner joint 12 having an angle of about 90° (FIG. 2) and extending between the ceiling 18 and floor (not shown) of a room within a building structure. In this regard, the drywall panels 16 are commonly used to define interior walls of a residential or commercial building structure. In the construction process, the inside corner joint 12 is filled with the plaster material 14 to form an attractive and smoothly radiused corner surface which blends smoothly and substantially continuously with the broad surfaces of the drywall panels 16. Additional inside corner joints, such as those shown in FIG. 1 to extend along the tops of the panels 16 and the ceiling panel 18 are also filled with plaster material, preferably with the use of the improved corner radius tool of the present invention.

As shown in FIG. 3, the tool 10 comprises a handle 20 adapted for easy manual grasping by a workman 22 (FIG. 1). A narrow tool shank 24 protrudes forwardly from the handle 20, and terminates in a forward tip 26 bent or angularly set with respect to a longitudinal axis of the handle 24. The shank tip 26 is received into a rearwardly open mounting boss 28 formed on a tool head 30. As shown, the tool head 30 comprises a resilient cup defining a forwardly open, generally concave cup interior 31. The cross-sectional geometry of the resilient cup may have a parabolic or hemispherical configuration. The outer diametric size of the resilient cup is preferably within the range of from about two inches to four inches. In typical use, more than one coat of the plaster material is applied to the inside corner joint, with a first coat being applied with a tool head having a diametric size of about two and one-half inches. A second or finish coat of the plaster material is then applied using a different tool head having a larger diameter of about three to three and one-half inches. In both instances, a tool head durometer on the order of about forty to fifty five Shore A hardness is preferred.

Figure 6:
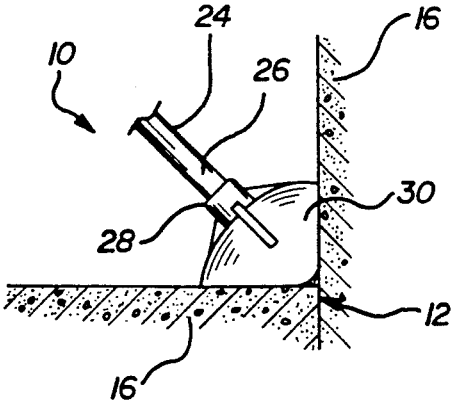
FIG. 6 is an enlarged fragmented horizontal sectional view taken generally on the line 6—6 of FIG. 5.
Figure 5:
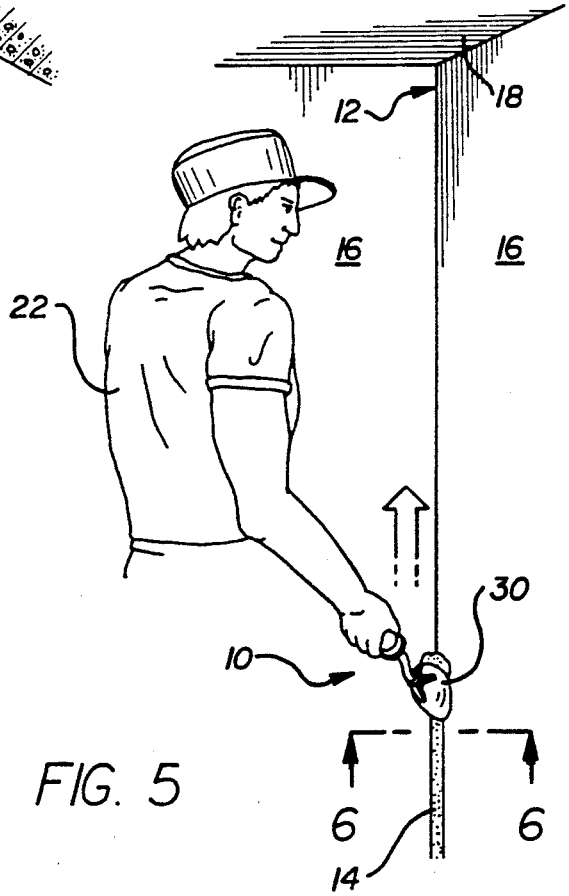
FIG. 5 is a fragmented perspective view similar to FIG. 1, but illustrating upward movement of the corner radius tool along an inside corner joint.

The plaster material 14 is normally mixed with water and a supply thereof is carried by the workman 22 in a hand-held tray 32. The tool 10 is easily maneuvered to scoop a quantity of the plaster material 14 into the concave interior 31 of the resilient cup 30. The tool head carrying the plaster material 14 is then pressed into the selected inside corner joint 12, while holding the resilient cup at a selected orientation and pressing toward the corner joint with a selected manual pressure. The resilient cup 30 deforms against the drywall panels 16 to reshape a trailing edge of the cup into a smoothly radiused surface for spreading the plaster material along the corner joint. FIGS. 1 and 2 show downward displacement of the tool 10 along the corner joint to spread the plaster material, whereas FIGS. 5 and 6 show upward displacement of the tool. In either case, a smoothly radiused corner surface of selected geometry, according to tool head orientation and manual pressure, is achieved. In general terms, increased manual pressure applied to the tool head causes greater deformation of the cup 30 and thus forms the plaster material with a sharper corner line.

Figure 7:
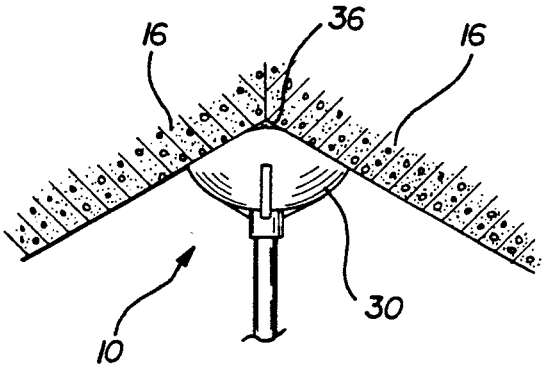
FIG. 7 is an enlarged fragmented horizontal sectional view similar to FIGS. 2 and 6, but illustrating use of the tool for applying plaster material to an inside corner joint of different angle.

FIG. 7 shows the corner radius tool 10 applied to an inside corner joint 36 of different angle, namely, an angle of about 120°. Once again, manual pressure applied to the tool head in a direction toward the corner, in combination with tool head orientation, provides a smoothly contoured and highly uniform radiused surface geometry as the tool is drawn along the corner joint to spread the plaster material.

FIG. 8 shows one alternative embodiment of the invention, wherein a modified handle 40 is mounted on the tool shank 24. The modified handle 40 has a rectangular cross-sectional geometry, whereby planar surfaces of the handle can be manually perceived by the workman to assist in maintaining a constant tool head orientation relative to a corner joint, as the implement is drawn along the corner joint to apply the plaster material.

The improved corner radius tool 10 of the present invention thus provides a versatile yet easy-to-use implement for applying and spreading plaster material with a smoothly radiused and substantially constant geometry along an inside corner joint of a building wall. The tool 10 can be used to form smoothly radiused corner joint surfaces at inside corners of different angles, and/or with different corner joint configurations, in accordance with the manner and orientation of tool use. Importantly, uniform and attractive corner joint surfaces can be formed quickly and easily, and without requiring extensive workman skill or training.

A variety of modifications and improvements to the corner radius tool of the present invention will be apparent to persons skilled in the art. Accordingly, no limitation on the invention is intended by way of the foregoing description and accompanying drawings, except as set forth in the appended claims.

What is claimed is:

1. A corner radius tool for filling an inside corner joint of a wall with a plaster material to form a smoothly radiused corner surface, said tool comprising:

a tool handle adapted for manual grasping and defining a forward end;

a tool head formed from a resilient material and having a generally cup-shaped geometry to define a generally concave cup interior; and means for supporting said tool head at said interior being presented generally in a forward outwardly facing direction away from said supporting means, whereby said tool head can be pressed into an inside corner joint at a selected manual pressure and drawn along said inside corner joint at a selected orientation to spread plaster material within said cup interior along said inside corner joint to form the smoothly radiused corner surface.

2. The corner radius tool of claim 1 wherein said tool head supporting means comprises a tool shank connected between said handle and said tool head.

3. The corner radius tool of claim 2 wherein said tool shank supports said cup at an angle of about thirty degrees with respect to a longitudinal axis of said tool handle.

4. The corner radius tool of claim 1 wherein said tool handle has a noncircular cross-sectional shape.

5. The corner radius tool of claim 1 wherein said tool handle has a generally rectangular cross-sectional shape.

6. The corner radius tool of claim 1 wherein said tool head is formed from an elastomer material.

7. The corner radius tool of claim 1 wherein said tool head has a diametric size from about two inches to about four inches.

* * * * *